US005819916A

United States Patent [19]

Lee

[11] Patent Number: 5,819,916

[45] Date of Patent: Oct. 13, 1998

[54] TWO-POSITION LATCHING TWO DOME SWITCH

[75] Inventor: James Sungioun Lee, Niles, Ohio

[73] Assignee: Packard Hughes Interconnect Company, Irvine, Calif.

[21] Appl. No.: 742,308

[22] Filed: Nov. 1, 1996

Related U.S. Application Data

[63] Continuation of Ser. No. 633,264, Apr. 18, 1996.

[51] Int. Cl.[6] ..... H01H 21/24

[52] U.S. Cl. ..... 200/557; 200/318; 200/5 R; 200/339; 200/512; 200/320

[58] Field of Search ..... 200/557, 553, 200/561, 339, 512, 515, 516, 5 R, 1 B, 5 E, 17 R, 318, 318.1, 320, 323

[56] References Cited

U.S. PATENT DOCUMENTS

| | | | |
|---|---|---|---|
| 2,897,327 | 7/1959 | DeSmidt et al. | 200/168 |
| 3,932,722 | 1/1976 | Obata et al. | 200/340 |
| 4,056,701 | 11/1977 | Weber | 200/314 |
| 4,263,485 | 4/1981 | Corwin | 200/5 A |
| 4,376,238 | 3/1983 | Martin | 200/159 B |
| 4,518,833 | 5/1985 | Watkins | 200/5 A |
| 4,527,030 | 7/1985 | Oelsch | 200/306 |
| 4,604,509 | 8/1986 | Clancy et al. | 200/159 B |
| 4,654,488 | 3/1987 | Westfall | 200/5 R |
| 4,794,215 | 12/1988 | Sawada et al. | 200/159 B |
| 4,892,988 | 1/1990 | Ishii | 200/516 |
| 5,224,591 | 7/1993 | Santo et al. | 200/516 |
| 5,399,823 | 3/1995 | McCusker | 200/521 |
| 5,412,164 | 5/1995 | Conway et al. | 200/1 B |
| 5,412,165 | 5/1995 | Malone et al. | 200/5 R |
| 5,426,275 | 6/1995 | Maeda et al. | 200/553 |
| 5,496,977 | 3/1996 | Date et al. | 200/339 |
| 5,559,311 | 9/1996 | Gorbatoff | 200/339 |
| 5,560,475 | 10/1996 | Brundage et al. | 200/339 |

*Primary Examiner*—David J. Walczak
*Attorney, Agent, or Firm*—Cary W. Brooks

[57] ABSTRACT

The invention includes a keycap having a top surface having a first and second end, and a body portion, said keycap being pivotally connected to a support for movement of the keycap from a first to a second position. A lever extending downward from the body portion of the keycap. The lever is sandwiched between and constantly engaged by a first and second opposed dome structures. Each dome structure has a conductive material on the underside thereof and the dome structure is supported on a substrate having an open circuit. In the first position for the keycap a first dome structure is collapsed and the electrically conductive element on the undersurface of the dome engages the open circuit to close the circuit. When the keycap is moved to a second position, the keycap pivots causing the lever to move in a rotational direction collapsing the second dome structure and said first dome structure biases the lever against the second dome structure. The present invention is simple in construction and low cost and provides improved tactile field over prior art latching switches.

7 Claims, 1 Drawing Sheet

TWO-POSITION LATCHING TWO DOME SWITCH

This application is a Continuation of Ser. No. 08/633,264, filed on Apr. 18, 1996.

FIELD OF THE INVENTION

This invention relates to switches, and particularly switches that latch.

BACKGROUND OF THE INVENTION

Many of the prior two-latch switches use a spring and a metal-ball method to latch the switches between two different positions. These systems include numerous parts and are difficult to construct and assemble thus making them costly compared to the present invention. Further, these spring and metal-ball switches have a tactile feel which is inconsistent and relatively poor compared to the present invention.

The present invention provides advantages over the prior art.

SUMMARY OF THE INVENTION

The invention includes a switch using two flexible domes that both engage the switch body and wherein the force exerted on the switch body by one dome is greater in one position and latches the switch in place. In one embodiment the invention includes a keycap having a top surface with a first and second ends; and a body portion. The keycap is pivotally connected to a support for movement of the keycap from a first to a second position. A lever extends downward from the body portion of the keycap. The lever is sandwiched between and constantly engaged by first and second opposed dome structures. Each dome structure has an electrically conductive element on the underside thereof and said dome structure is supported on a substrate having an open circuit. In a first position, the first dome structure is collapsed and the electrically conductive element on the undersurface of the dome engages the open circuit to close the circuit and the second dome biases the lever against the first dome latching the switch in a first position. When the keycap is pivoted to a second position, the lever moves in a rotational direction collapsing said second dome structure and said first dome structure biases the lever against the second dome structure latching the switch in a second position. The present invention is simple in construction and low cost and provides improved tactile field over prior art latching switches.

These and other objects, features and advantages of the present invention will become apparent from the following brief description of the drawings, detailed description and appended claims and drawings.

DETAILED DESCRIPTION

Figure 1:
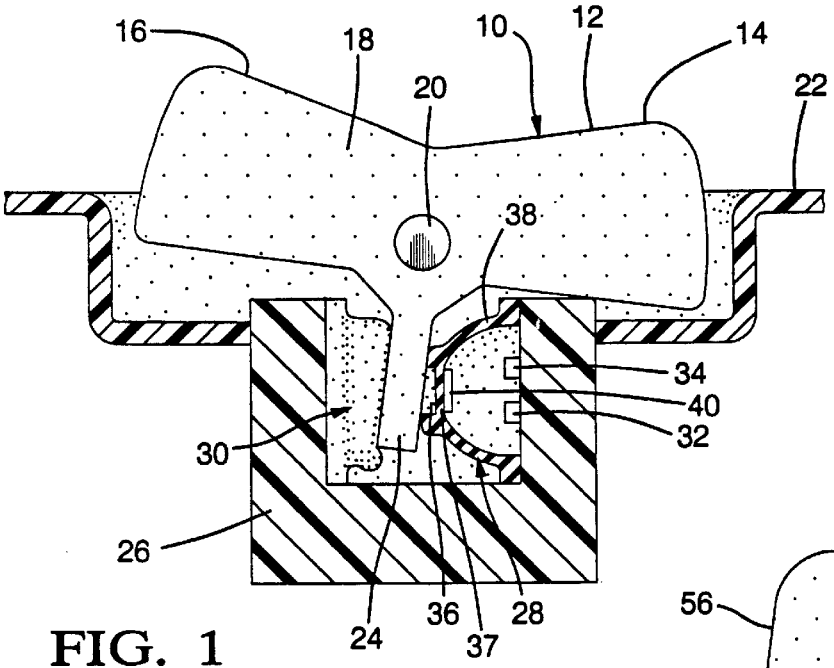
FIG. 1 is a partially sectioned side elevational view of a two-position latching two dome switch according to the present invention.

FIG. 1 illustrates one embodiment of a two-position latching two dome switch according to the present invention. The switch preferably includes a substantially rectangular keycap 10 having a top surface 12 with first and second ends 14, 16 and a body portion 18 which is pivotally connected to a housing 22 with the aid of a pin 20 extending through the body portion. The keycap also includes a lower surface from which a lever 24 extends in a downward direction. The lever is received in an U-shaped housing 26 having first and second opposed dome structures 28, 30 carried thereon. Each dome structure is a nonmetallic, flexible, preferably elastomeric dome positioned to bias the lever 24. Preferably each dome is made from a silicone or other suitable elastomer.

To move the switch to a first position, the first end 14 of the keycap is pushed downward causing the lever 24 to rotate and collapse the second dome 30 and so that the first dome structure 28 biases and latches the lever 24 and keycap in the first position. In this first position, the first dome structure 28 exerts a greater force on the lever 24 than the second dome structure 30 allowing the keycap and lever to be latched in the first position.

To move the switch to a second position, the second end 16 of the keycap is depressed causing the lever 24 to rotate in the opposite direction collapsing the first dome 28 and wherein the second dome 30 biases and latches said lever 24 and keycap in said second position. In this second position, the second dome structure 30 exerts a greater force on the keycap than the first dome structure 28 allowing the switch to be latched in the second position.

In one embodiment, the invention includes a stationary support (such as the U-shaped housing) for the domes which carry a plurality of closely spaced contacts or ends of traces 32, 34 of a printed circuit. The nonmetallic, flexible, preferably elastomeric dome is mounted on the stationary support 26 or printed circuit which overlies contacts or ends of the traces. The elastomeric dome has a resilient, annular outer ring 36 of a given thickness, and downwardly extending flexible sidewall 38. A thinner membrane 37 underlies the annular ring and an electrically conductive pellet 40 is carried on the underside thereof. As the dome is collapsed by the depression of one end of the keycap and the corresponding rotation of the lever, the electrically conductive pellet 40 on the underside of the dome engages the spaced-apart traces 32, 34 closing a circuit and sending a device associated with the switch. Such a device might include typically in an automobile a driver's side window or mirror switch module.

Figure 2:
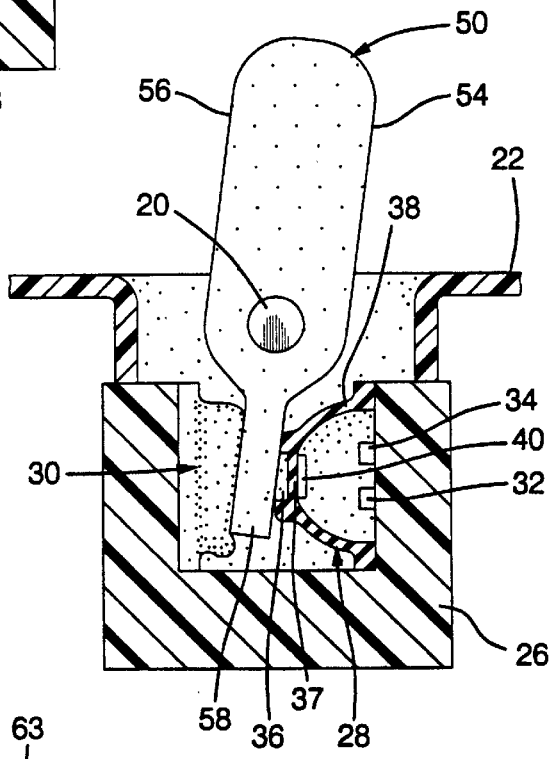
FIG. 2 is a partially sectioned side elevational view of a two position latching two dome switch having a pedestal according to the present invention.

FIG. 2 illustrates another embodiment of the present invention wherein a pedestal cap 50 having first and second side surfaces 54, 56 and a downwardly extending lever 58. The pedestal cap 50 is pivotally mounted to the housing 22 by a pin 20. The domes 28 and 30 are constructed as shown in FIG. 1. To move the switch from first to second positions and vice versa, the operator pushes on a respective side surface of the pedestal.

Figure 3:
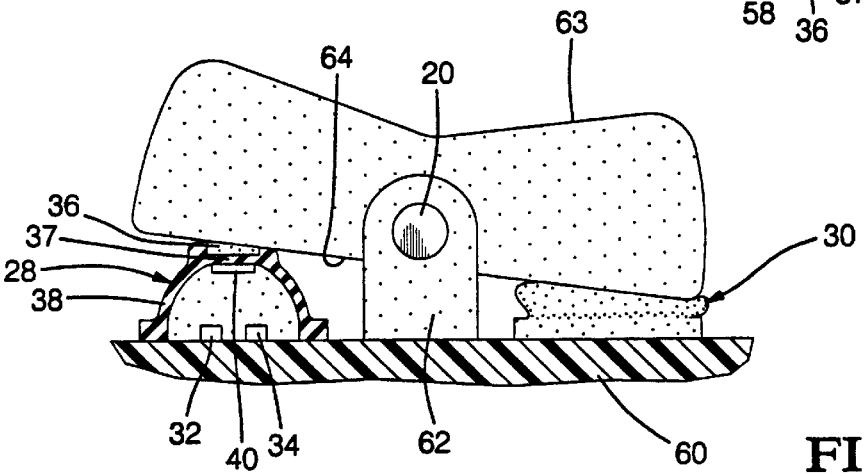
FIG. 3 is a partially sectioned side elevational view of a two position latching two dome switch according to the present invention.

FIG. 3 illustrates another embodiment of the present invention wherein the first and second domes 28, 30 are mounted on a flat substrate 60. A mounted arm 62 extends upward from the substrate 66 and a keycap 63 is pivotally mounted to the mounting arm 62 by a pin 20. The underside 64 of the keycap 63 engages each dome 28, 30. The switch is latched in a first or second position by selectively depressing ends of the keycap 63 in a manner as described with respect to FIG. 1. Again, the domes 28, 30 are constructed as shown in FIG. 1.

What is claimed is:

1. A two-position latching two dome switch comprising:

a switch control member body having a portion pivotally connected to a support for movement of the member from a first position to a second position;

first and second nonmetallic, flexible domes, each of said domes being constructed and arranged to continually engage a portion of said switch control member;

whereby upon movement of said switch control member to a first position, said member collapses said first dome and said second dome is extended and engages said member to latch said switch control member in said first position wherein said first dome is collapsed, and upon movement of said switch control member to said second position said member pivots to collapse said second dome and said first dome is extended and engages said member to latch said switch control member in said second position wherein said second dome is collapsed.

2. A two-position latching two dome switch as set forth in claim 1 wherein said switch control member comprises a substantially rectangular keycap having a top surface with first and second ends each being depressible to cause said keycap to move from one of a first and a second position.

3. A two-position latching two dome switch as set forth in claim 1 wherein said switch further comprises a pedestal extending upwardly from said body portion.

4. A two-position latching two dome switch as set forth in claim 1 further comprising a lever extending downward from said body portion and wherein said first and second dome engage opposite sides of the lever.

5. A two-position latching two dome switch as set forth in claim 1 wherein said support is a substantially flat substrate.

6. A two-position latching two dome switch as set forth in claim 1 wherein said support is a U-shaped member and said domes are position to face each other.

7. A two-position latching two dome switch as set forth in claim 1 wherein said first nonmetallic, flexible dome includes an electronically conductive element carried on the underside of the dome, said first dome being mounted on a support having spaced apart conductive traces thereon associated with an electrical circuit.

* * * * *